US011688951B2

(12) United States Patent
Komov et al.

(10) Patent No.: US 11,688,951 B2
(45) Date of Patent: Jun. 27, 2023

(54) WIDEBAND DUAL-POLARIZED ANTENNA

(71) Applicant: Guangzhou Sigtenna Technology Co., Ltd., Guangdong (CN)

(72) Inventors: Vladislav Komov, Rostov Region (RU); Victor Aleksandrovich Sledkov, Wellington (NZ); Zimeng Li, Guangdong (CN)

(73) Assignee: Guangzhou Sigtenna Technology Co., Ltd., Guangzhou (CN)

( * ) Notice: Subject to any disclaimer, the term of this patent is extended or adjusted under 35 U.S.C. 154(b) by 143 days.

(21) Appl. No.: 17/474,026

(22) Filed: Sep. 13, 2021

(65) Prior Publication Data

US 2022/0013920 A1 Jan. 13, 2022

Related U.S. Application Data

(63) Continuation of application No. PCT/CN2019/113043, filed on Oct. 24, 2019.

(30) Foreign Application Priority Data

Mar. 12, 2019 (CN) ..... 201910184207.1

(51) Int. Cl.
*H01Q 1/42* (2006.01)
*H01Q 19/02* (2006.01)
(Continued)

(52) U.S. Cl.
CPC ..... *H01Q 19/028* (2013.01); *H01Q 1/42* (2013.01); *H01Q 1/421* (2013.01); *H01Q 1/422* (2013.01);
(Continued)

(58) Field of Classification Search
CPC ..... H01Q 1/42; H01Q 1/421; H01Q 1/422; H01Q 1/424; H01Q 1/427; H01Q 1/428;
(Continued)

(56) References Cited

U.S. PATENT DOCUMENTS 5,940,044 A 8/1999 Smith
7,209,091 B2 * 4/2007 Schadler ..... H01Q 1/246 343/810
(Continued)

FOREIGN PATENT DOCUMENTS

CN 106229698 A * 12/2016 ..... H01Q 1/36
CN 108172978 A 6/2018
(Continued)

OTHER PUBLICATIONS

International Search Report of PCT Patent Application No. PCT/CN2019/113043 dated Jan. 2, 2020.

*Primary Examiner* — Vibol Tan

(57) ABSTRACT

The application discloses a wideband dual-polarized antenna, including a reflective plate and a radiating element mounted on the reflective plate. The radiating element includes four dipoles which are combined together to be arranged on the reflective plate; two arms of each dipole are respectively connected to top ends of two conductor, and bottom ends of the conductor are connected to a common base and are placed on the reflective plate; a focusing member with a conical structure is mounted above the radiating element, and includes conductive members and dielectric members. The conductive members are arranged on the dielectric members in an axisymmetrical manner, are supported by the dielectric members and are arranged above the dipoles. The beamwidth is adjusted by arranging the focusing member with the conical structure above the radiating element so that the wideband dual-polarized antenna has the beamwidth reaching the desired range, has lower cross polarization ratio.

10 Claims, 8 Drawing Sheets

(51) Int. Cl.
*H01Q 19/10* (2006.01)
*H01Q 21/00* (2006.01)
*H01Q 21/26* (2006.01)

(52) U.S. Cl.
CPC ..... *H01Q 19/108* (2013.01); *H01Q 21/0006* (2013.01); *H01Q 21/26* (2013.01)

(58) Field of Classification Search
CPC ..... H01Q 1/36; H01Q 19/108; H01Q 5/25; H01Q 15/14; H01Q 15/24; H01Q 19/062; H01Q 9/28; H01Q 19/028; H01Q 21/0006; H01Q 21/26; H01Q 1/523; H01Q 9/26; H01Q 21/062; H01Q 19/02; H01Q 19/104; H01Q 19/106; H01Q 21/24; H04B 7/0413
See application file for complete search history.

(56) References Cited

U.S. PATENT DOCUMENTS

| | | | | |
|---|---|---|---|---|
| 9,595,756 | B1 * | 3/2017 | Buckley | H01Q 19/005 |
| 9,917,361 | B2 * | 3/2018 | Moon | H01Q 1/1264 |
| 10,819,042 | B2 * | 10/2020 | Xia | H01Q 19/108 |

FOREIGN PATENT DOCUMENTS

| | | | | |
|---|---|---|---|---|
| CN | 109980329 | A * | 7/2019 | |
| CN | 209526201 | U | 10/2019 | |
| WO | WO-2006119454 | A1 * | 11/2006 | H01Q 1/22 |
| WO | WO-2012037810 | A1 * | 3/2012 | H01Q 1/246 |

* cited by examiner

WIDEBAND DUAL-POLARIZED ANTENNA

CROSS REFERENCE TO RELATED APPLICATIONS

The present application is a Continuation Application of PCT Application No. PCT/CN2019/113043 filed on Oct. 24, 2019, which claims the benefit of Chinese Patent Application No. 201910184207.1 filed on Mar. 12, 2019. All the above are hereby incorporated by reference in their entirety.

FIELD OF THE INVENTION

The present application relates to the field of antennas, in particular to a wideband dual-polarized antenna.

BACKGROUND OF THE INVENTION

In today's era of frequent use of mobile phones, the market has a huge demand for wideband dual-polarized antennas each year, so that considerable labor and material resources are invested to develop and manufacture simple wideband dual-polarized antennas to meet the market demand in the industry. During practical use, in most cases, a horizontal-plane half-power beamwidth of a dual-polarized antenna is required to be 65 degrees, and the antenna is required to not only has good cross-polar discrimination but also to be well matched with a feed line in a wider band.

Because a horizontal-plane beamwidth of a cross dipole is too wide, a radiator having a complicated structure needs to be used in order to meet the demand on reduction of the beamwidth. A patent document U.S. Pat. No. 5,940,044 describes a dual-polarized antenna having a horizontal-plane half-power beamwidth being about 65 degrees, and the antenna includes a plurality of dipole subarrays, each subarray consisting of four dipoles; two of the dipoles in each subarray are oblique and form a +45-degree angle together with a long side of a ground plate so as to form a polarized radiating element array having the +45-degree angle; and moreover, the other two dipoles form a −45-degree angle with the long side of the ground plate so as to form a polarized radiating element array having the −45-degree angle. The dipoles are arranged in this way, so that a phase center of the dipoles with the +45-degree angle and a member with the −45-degree angle can be aligned with a vertical line parallel to the long side of the ground plate. A few years ago, in the industry, the size of the radiating elements was reduced by a technology optimizing design in which arms of dipoles were bent towards a phase center. Nowadays, most base station antenna arrays employ the radiating element structure.

A modernized multi-input multi-output antenna array includes at least two rows of adjacent radiators. As a result of such a structure configuration, a reflective plate is larger in size, and the wind load is increased accordingly. Therefore, in order to reduce the size of the reflective plate while achieving a structure in which radiators are adjacent to each other, it is necessary to employ a dual-polarized radiating element having a 65-degree horizontal-plane beamwidth and good cross-polar discrimination.

A patent document CN108172978A describes a dual-polarized antenna which has the solution that the dual-polarized antenna includes four dipoles, wherein additional conductive members are arranged on arms of the dipoles, as shown in FIG. 1; the additional conductive members are placed on dielectric spacers located on the arms of the dipoles and used to reduce the beamwidth of the antenna; as the result of the design, the dual-polarized antenna in the patent document CN108172978A has a beamwidth that, although reduced, cannot be reduced to the desired 60-65 degrees compared to other existing dual-polarized antennas if the size of the reflective plate is reduced, and therefore, the technology design cannot meet most of the practical application demands; and moreover, another drawback of the antenna is that the cross polarization ratio is low.

SUMMARY OF INVENTION

An objective of the present application is to provide a wideband dual-polarized antenna with an improved structure for the problems that a beamwidth cannot reach expectations easily and a cross polarization ratio is low in dual-polarized antennas in the prior art.

To achieve the above objective, the present application employs the following technical solution.

The present application discloses a wideband dual-polarized antenna, including a reflective plate and a radiating element mounted on the reflective plate. The radiating element includes four dipoles which are combined to be arranged on the reflective plate; two arms of each dipole are respectively connected to top ends of two conductors, and bottom ends of the conductors are connected to a common base and are placed on the reflective plate; a focusing member with a conical structure is mounted above the radiating element, and includes conductive members and dielectric members; and the conductive members are arranged on the dielectric members in an axisymmetrical manner, are supported by the dielectric members and are arranged above the dipoles.

It should be noted that the wideband dual-polarized antenna of the present application is able to effectively adjust the beamwidth to a desired range by arranging the focusing member with the conical structure above the radiating element, and a cross polarization ratio is relatively low. In an implementation manner of the present application, a half-power beamwidth is 60-65 degrees, and meanwhile, a cross polarization ratio at edges of a +/−60-degree sector is less than −10 dB, and most practical application demands can be met.

Preferably, the focusing member has a conical structure and has a circular, elliptical or polygonal cross section.

It should be noted that the key points of the present application lie in that the focusing member has a conical structure, or may be a cone structure being conical, pyramidal or other polygonal, that is, the cross section of the focusing member is circular or polygonal, depending on the specific design requirements.

Preferably, the radiating element includes four balun-fed folded dipoles tilting for 30-90°.

Preferably, arms of the dipoles are bent towards the central direction of the radiating element.

Preferably, a top of the focusing member with the conical structure is excised in part.

Preferably, in the focusing member, the conductive members have a square, circular, ring-shaped, or other polygonal structure, and the conductive members are placed at an axial portion of the radiating element and are parallel to the reflective plate. The ring-shaped structure may be a circular ring or a polygonal ring; and the ring may be a circular ring or a polygonal ring with an integral structure, or may also be formed by enclosing four segments of straps corresponding to the four dipoles.

Preferably, the conductive members are supported by the dielectric members and are arranged the dipoles respectively; The conductive members are in a shape of a strap, a curved bar, a rectangle, an arc, or a portion of a polygon.

In an implementation manner of the present application, the focusing member has a conical structure formed by enclosing of four dielectric member panels, and the conductive members are in a strap shape, and are attached to the dielectric member panels; the conductive members on the four dielectric member panels are arranged in an axisymmetrical manner; or, the focusing member has a conical frame structure formed by enclosing of four dielectric member posts, and the conductive members in a ring shape are fixed on a dielectric member post frame.

Preferably, in the wideband dual-polarized antenna of the present application, at least two radiating elements and feeding parts are placed on the reflective plate to form a dual-polarized antenna array.

Preferably, the reflective plate is at least provided with two side walls.

Preferably, the wideband dual-polarized antenna is provided with a radome with a circular tube shape.

Due to the adoption of the above technical solution, the present application has the following beneficial effects:

in the wideband dual-polarized antenna of the present application, the beamwidth is adjusted by arranging the focusing member with the conical structure above the radiating element so that the wideband dual-polarized antenna has the beamwidth reaching the desired range, the low cross polarization ratio and can better meet the practical application demands.

DETAILED DESCRIPTION OF ILLUSTRATED EMBODIMENTS

Figure 1:
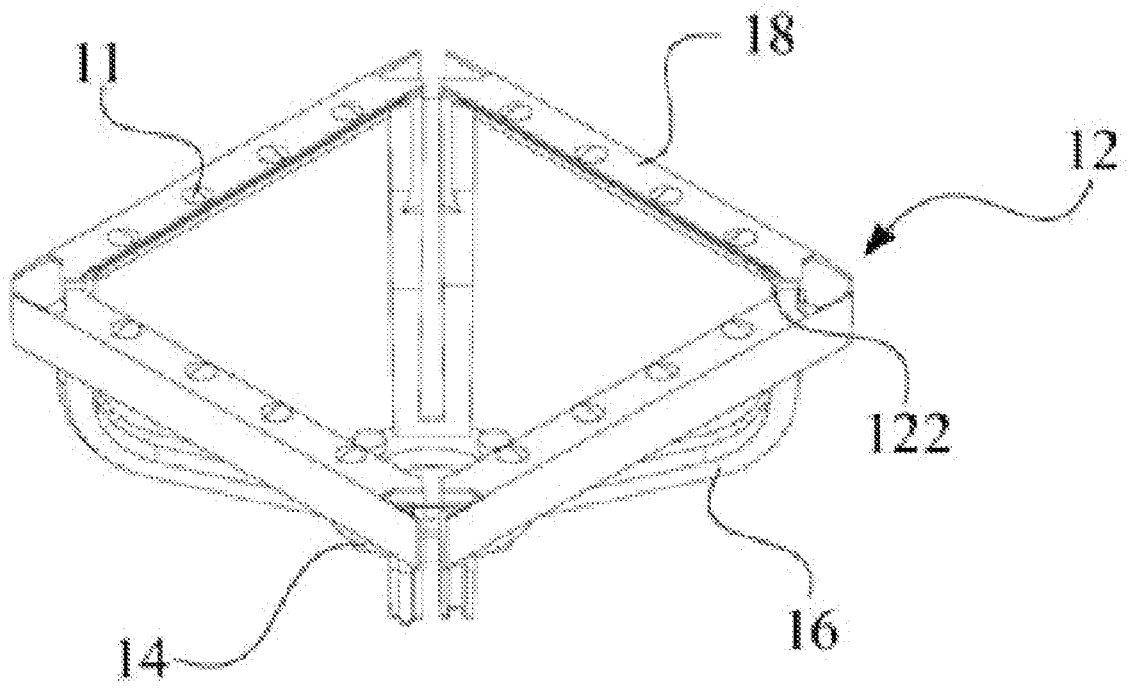
Fig. 1 (Prior Art)
FIG. 1 is a structural schematic diagram of a dual-polarized antenna in the patent CN108172978A in the prior art.

An existing dual-polarized antenna, for example, a dual-polarized antenna described in the patent document CN108172978A, as shown in FIG. 1, includes four dipoles 12, wherein arms of the four dipoles are respectively connected to top ends of respective feed baluns 16; the feed baluns 16 are connected to a base 14 in a radial axisymmetrical manner; loading members 18 are arranged on the dipoles respectively, the loading members 18 are arranged along the arms of the dipoles and are fixed on the arms of the dipoles by dielectric members; middle parts of the loading members 18 are arranged between tail ends of the arms of the adjacent dipoles; the radiating element has a square structure in a top view; and a coupling length of the loading members 18 and the arms of the dipoles is approximately two times a length of an arm of a single dipole, so that the design in which the loading members 18 are included reduces the beamwidth of the radiating element, but does not increase the cross polarization ratio.

Figure 2:
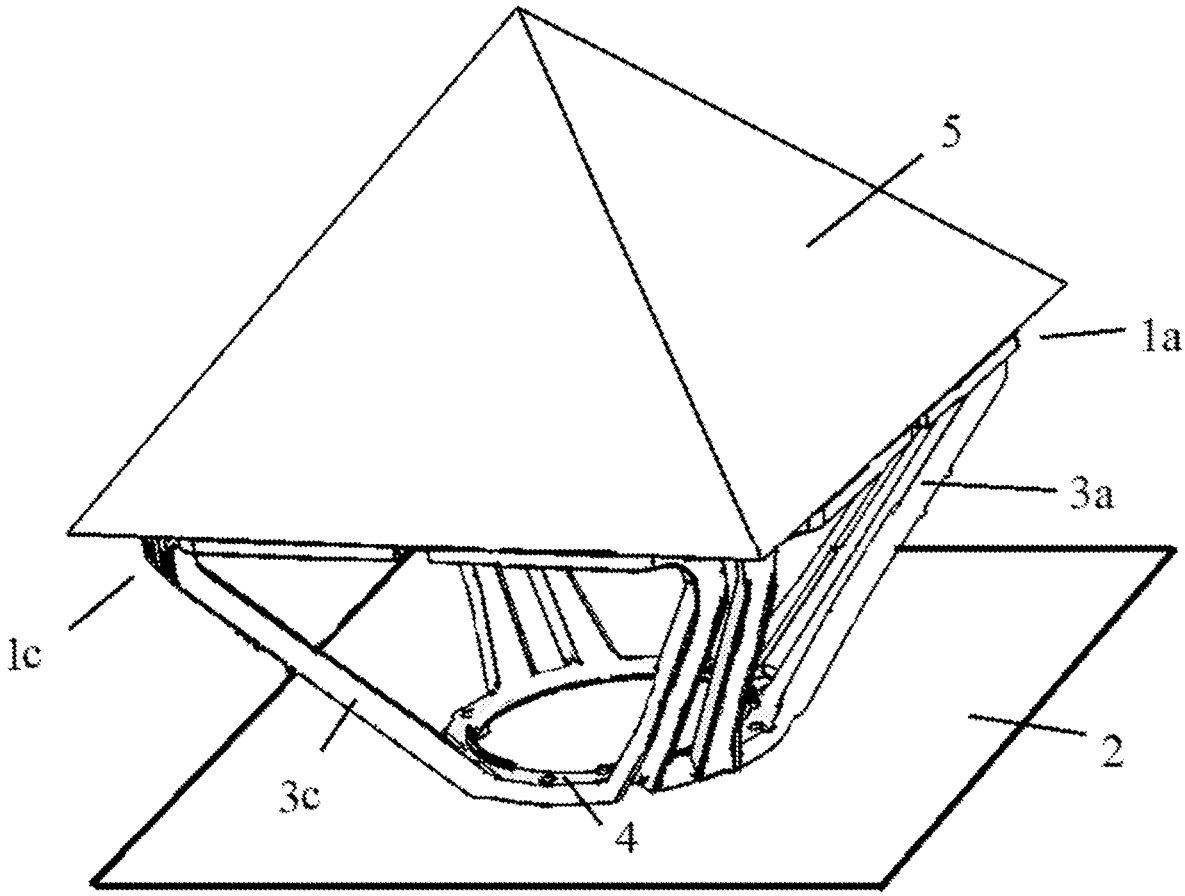
FIG. 2 is a structural schematic diagram of a dual-polarized antenna in Embodiment 1 of the present application.

Therefore, the present application inventively provides that a focusing member with a conical structure is installed above a radiating element, as shown in FIG. 2, the focusing member includes conductive members and dielectric members, wherein the conductive members are arranged on the dielectric members in an axisymmetrical manner, and the conductive members are supported by the dielectric members and arranged above dipoles. A dual-polarized antenna of the present application is placed on a miniaturized reflective plate, is able to meet the requirements that the half-power beamwidth is 60-65 degrees, and has a cross polarization ratio being less than −10 dB at edges of a +/−60-degree sector.

Compared with the existing technical solution, the dual-polarized antenna of the present application has the reduced half-power beamwidth, and the antenna having the focusing member with the conical structure obtains higher gains. In addition, the dual-polarized antenna of the present application can increase the cross polarization ratio at the edges of the +/−60-degree sector, and by employing the design that the focusing member has the conical structure, the difference of the beamwidths of an E plane and an H plane is reduced; the dielectric members and the conductive members that jointly constitute the focusing member with the conical structure can change the radiation characteristics of the dual-polarized antenna, and thus, the cross polarization ratio of the antenna can be increased by adjusting the sizes of these components. The dual-polarized antenna of the present application is capable of reducing coupling interference between adjacent antennas. Specifically, the focusing member with the conical structure can focus radiation waves from the arms of the dipoles, and meanwhile, can reduce radiation interference generated by the reflective plate the surface of which is provided with adjacent antennas to increase the overall performance of the antenna.

The present application is further described in detail below by way of specific embodiments and drawings. The following embodiments are only for further illustrating the present application and should not be construed as limiting the present application.

Embodiment 1

A wideband dual-polarized antenna of the embodiment includes a reflective plate and a radiating element mounted on the reflective plate. The radiating element, as shown in FIG. 2, includes four dipoles that are a first dipole 1*a*, a second dipole, a third dipole 1*c* and a fourth dipole clockwise in sequence, wherein the first dipole 1*a* and the third dipole 1*c* are orthogonally polarized, and the second dipole and the fourth dipole are orthogonally polarized; and the four dipoles are distributed in a square structure and are placed on a reflective plate 2. Two arms of each dipole are respectively connected to top ends of two conductors, the four dipoles correspond to four groups of conductors, and each group of conductors consists of two conductors which are respectively connected to the two arms of each dipole. That is, the first dipole 1*a* corresponds to a first group of conductors 3*a*, and the third dipole corresponds to the third group of conductors 3*c*. Bottom ends of the conductors are connected to a common base 4 and are mounted on the reflective plate 2. A focusing member 5 with a conical structure is mounted above the radiating element, and includes conductive members and dielectric members, wherein the conductive members are arranged on the dielectric members in an axisymmetrical manner, and the conductive members are supported by the dielectric members and arranged above the dipoles.

Compared with a structural form of a focusing conductive member of an existing antenna, the design of the focusing member 5 with the conical structure in the embodiment can more efficiently focus radiation from the arms of the dipoles, making beams produced by the dual-polarized antenna of the present application narrower. Alternatively, in the case that beamwidths are the same, the size of the reflective plate of the antenna of the present invention may be smaller. In addition, compared with the existing technical solution, the dual-polarized antenna of the present application can increase the cross polarization ratio at the edges of the +/−60-degree sector, and the employed focusing member with the conical structure can reduce the difference of the beamwidths of the E plane and the H plane. The focusing member with the conical structure is constituted by the dielectric members and the conductive elements jointly, can change the radiation characteristics of the antenna, and thus, in practical use, the cross polarization ratio of the antenna can be increased by adjusting the sizes of the components.

Embodiment 2

Figure 3:
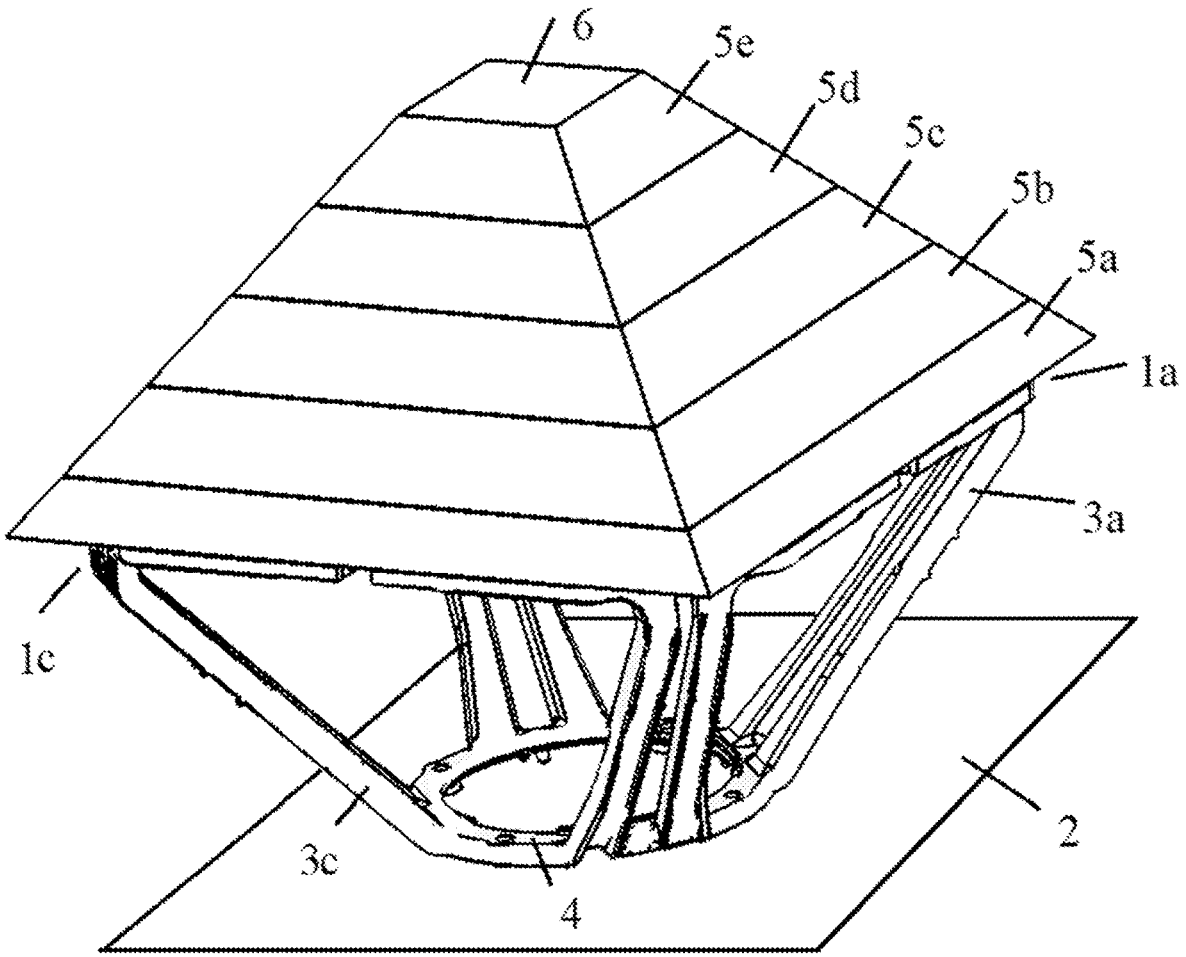
FIG. 3 is a structural schematic diagram of a dual-polarized antenna in Embodiment 1 of the present application.
Figure 4:
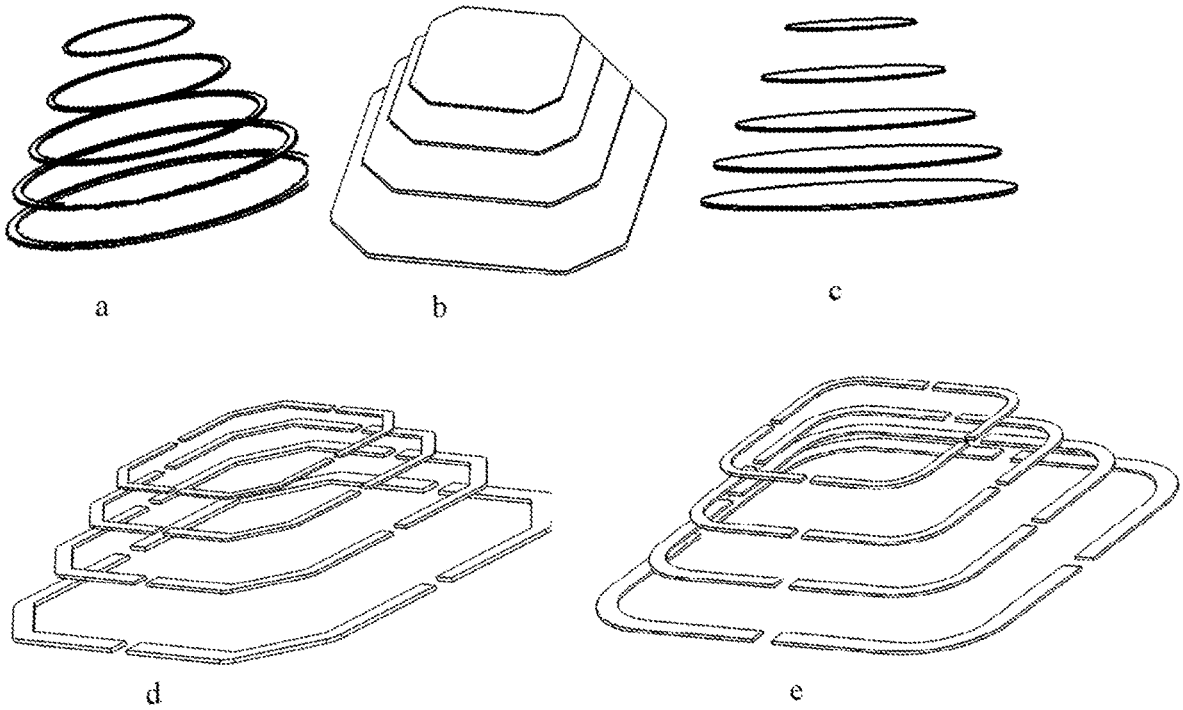
FIG. 4 is a structural schematic diagram of a multi-layer conductive member of a dual-polarized antenna in Embodiment 2 of the present application.

A wideband dual-polarized antenna of the embodiment is similar to that in the embodiment 1, and has the differences that the focusing member with the conical structure specifically employs a pyramid structure. As shown in FIG. 3, a pyramidal focusing member consists of five dielectric members 5*a*, 5*b*, 5*c*, 5*d* and 5*e* that taper from bottom to top, a top of the pyramidal focusing member is excised in part, that is, the top is a horizontal section 6, and the horizontal section 6 is parallel to the reflective plate. A conductive member is arranged on a plane between the two dielectric members, that is, four planar conductive members are present; or a conductive member is arranged in a plane between two dielectric members and on the horizontal section 6 on the top, that is, five planar conductive members are present; and the multiple layers of conductive members are parallel to each other and parallel to the reflective plate, and each layer of conductive member gradually tapers from bottom to top according to a pyramid shape. The conductive members may have a structure being in a complete sheet shape or a complete ring shape, or may also have a structure being in a ring shape formed by splicing multiple segments, as shown in FIG. 4. FIG. 4 shows conductive members in different shapes and structures and arrangement manners thereof, wherein view a shows five layers of ring-shaped conductive members, and each layer is a ring-shaped conductive member; view b shows four layers of octagonal sheet-like conductive members, and each layer is an octagonal sheet-like conductive member; view c shows five layers of circular sheet-like conductive members; view d shows four layers of ring-shaped conductive members, each layer is an octagonal ring formed by enclosing of four straps; view e shows four layers of conductive members, each layer is a quadrangular ring formed by enclosing of four straps and four corners of the quadrangular ring are rounded arc. It can be understood that the dielectric members may be in a uniform pyramid in which the conductive members in different structures or shapes are embedded; or may also be in a shape adaptive to the conductive members, for example, conductive members in a circular or ring shape correspond to dielectric members in the corresponding shape to form a conical focusing member, or conductive members in another shape correspond to dielectric members in the corresponding shape to form a focusing member with a conical structure.

The conductive members in the embodiment, for example, sheet-like conductive members, are placed on an axis part of the radiating element, or bent conductive members in a strap-shaped structure are placed above the arms of the dipoles, and can promote the focusing effect of the focusing member with the conical structure.

Therefore, in the case that the focusing member with the conical structure and multiple layers of conductive members is employed, by changing the dielectric properties of the dielectric members, or optimizing the shape or structure of the conductive members, the dual-polarized antenna can acquire a direction diagram meeting requirements in a wider band range, and good matching between the radiating element and a feed line is achieved. For example, the dielectric members placed at different layers of the focusing member with the conical structure need to be reduced in dielectric constants, and may be considered to be fabricated by using different materials including porous foam-like materials. With such a multilayer focusing member with the conical structure and having conductive members arranged inside, it is possible to obtain a desired radiation direction diagram according to the practical use demands and to reduce the height of the focusing member. Therefore, for the antenna including the focusing member with the conical structure in the embodiment, the usage amount of dielectric materials can be reduced, meanwhile, the size of a radome is reduced, the design and fabrication are simplified, the space is saved, and the cost is lowered.

Embodiment 3

Figure 5:
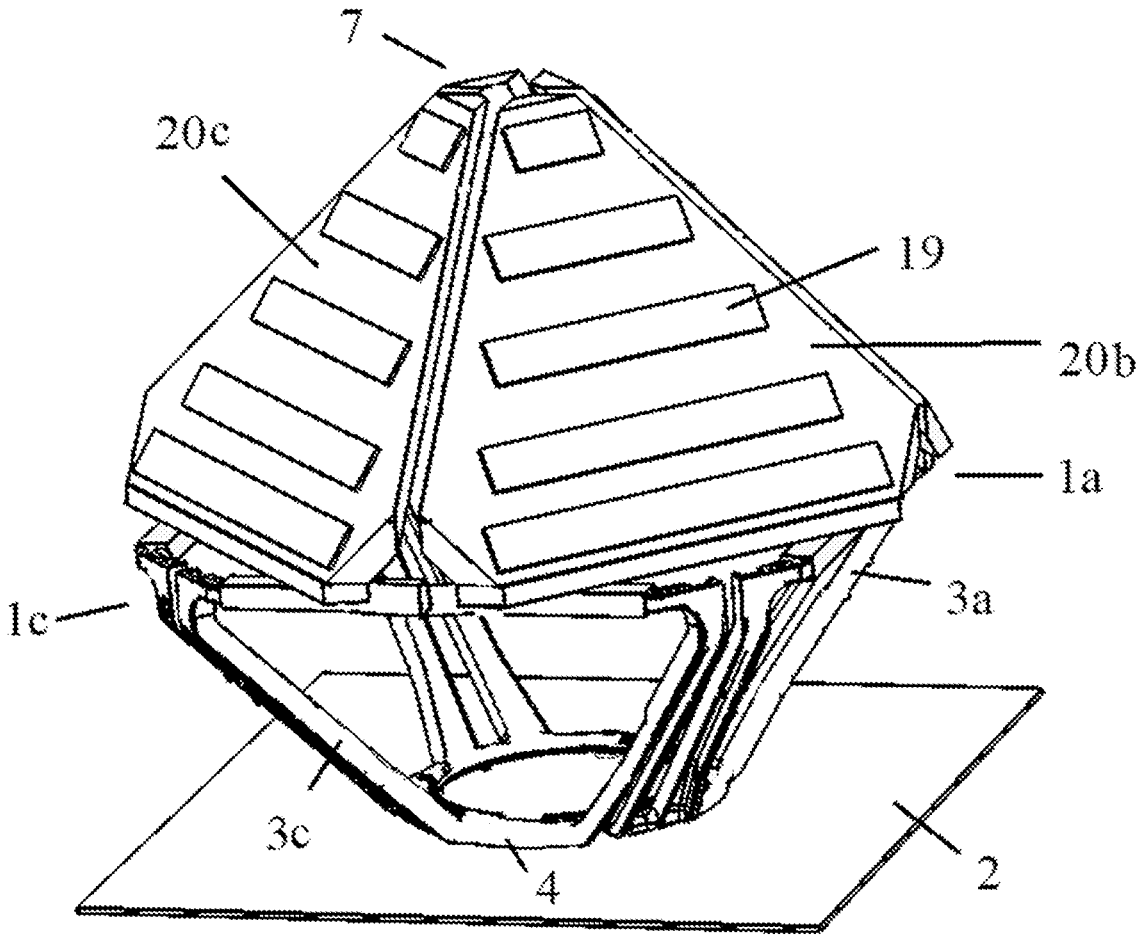
FIG. 5 is a structural schematic diagram of a dual-polarized antenna in Embodiment 3 of the present application.

A wideband dual-polarized antenna in the embodiment is similar to that in the embodiment 1, and has the differences that as shown in FIG. 5, a focusing member 7 includes four insulating dielectric block panels, i.e., a first insulating dielectric block panel, a second insulating dielectric block panel 20*b*, a third insulating dielectric block panel 20*c* and a fourth insulating dielectric block panel, which enclose to form a conical structure; conductive members are in a strap shape, i.e., conductive metal straps 19 are attached on the insulating dielectric block panels, arranged above arms of dipoles, and are fixed on a radiator by low edges of the conductive metal straps; and the conductive members on four insulating dielectric block panels are arranged in an axisymmetrical manner, as shown in FIG. 5, the conductive members can also enclose to form a multi-layer structure similar to that of FIG. 4, and FIG. 5 shows five layers of conductive members. Compared with the focusing member as shown in FIG. 3, the focusing member employing the optimized design is lighter in weight and easier to fabricate.

Embodiment 4

Figure 6:
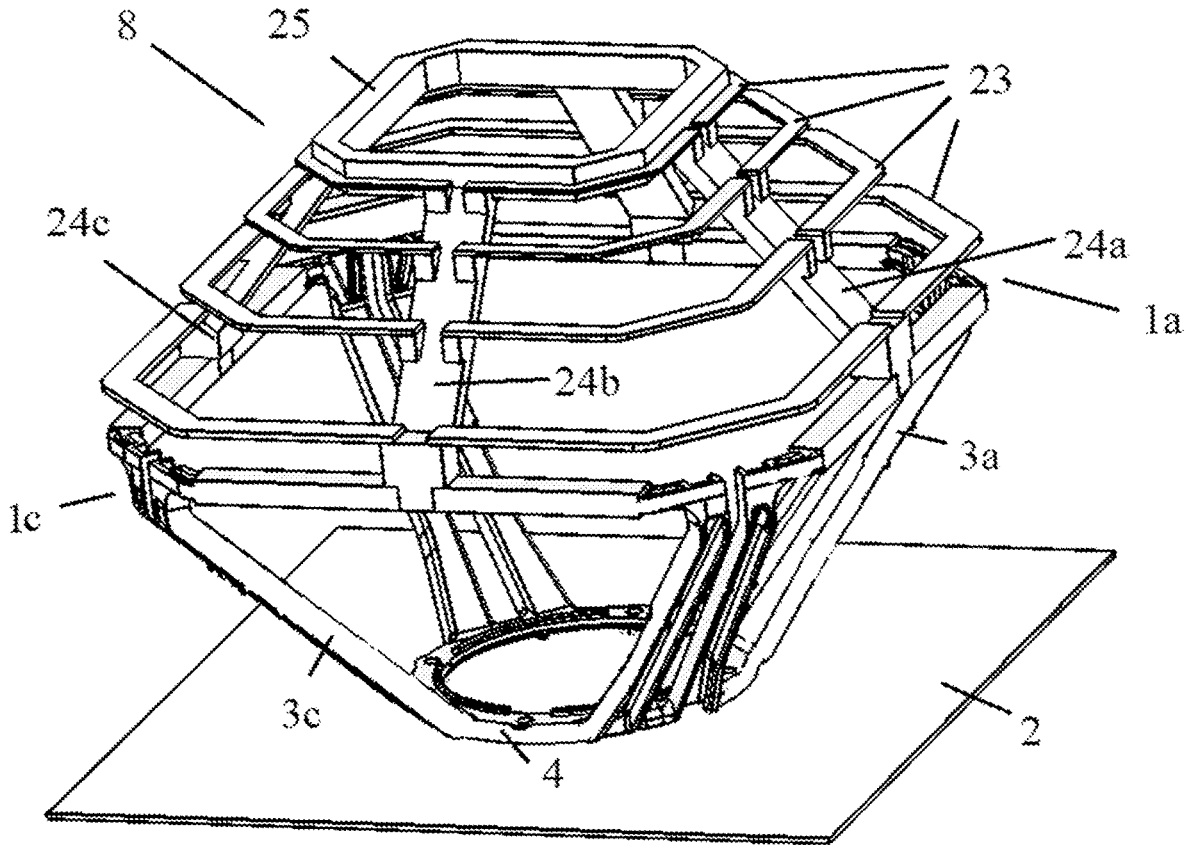
FIG. 6 is a structural schematic diagram of a dual-polarized antenna of Embodiment 4 of the present application.

A wideband dual-polarized antenna in the embodiment is similar to that in the embodiment 1, and has the differences that as shown in FIG. 6, a focusing member 8 includes four dielectric member posts, i.e., a first dielectric member post

24*a*, a second dielectric member post 24*b*, a third dielectric member post 24*c* and a fourth dielectric member post, which enclose to form a conical frame structure a top end of which is provided with an annular dielectric member 25 that connects the dielectric member posts together; bent conductive members 23 are arranged in a strap-shaped structure above arms of dipoles and are fixed by the four dielectric member posts; likewise, the conductive members 23 are ring-shaped conductive members in a four-layer structure, the four bent conductive members in a strap-shaped structure enclose to form a ring at each layer, the four bent conductive members in the strap-shaped structure are respectively connected to the four dielectric member posts end to end to be fixed; and the focusing member with the design enables efficient focusing and meanwhile is lighter in weight.

Embodiment 5

Figure 7:
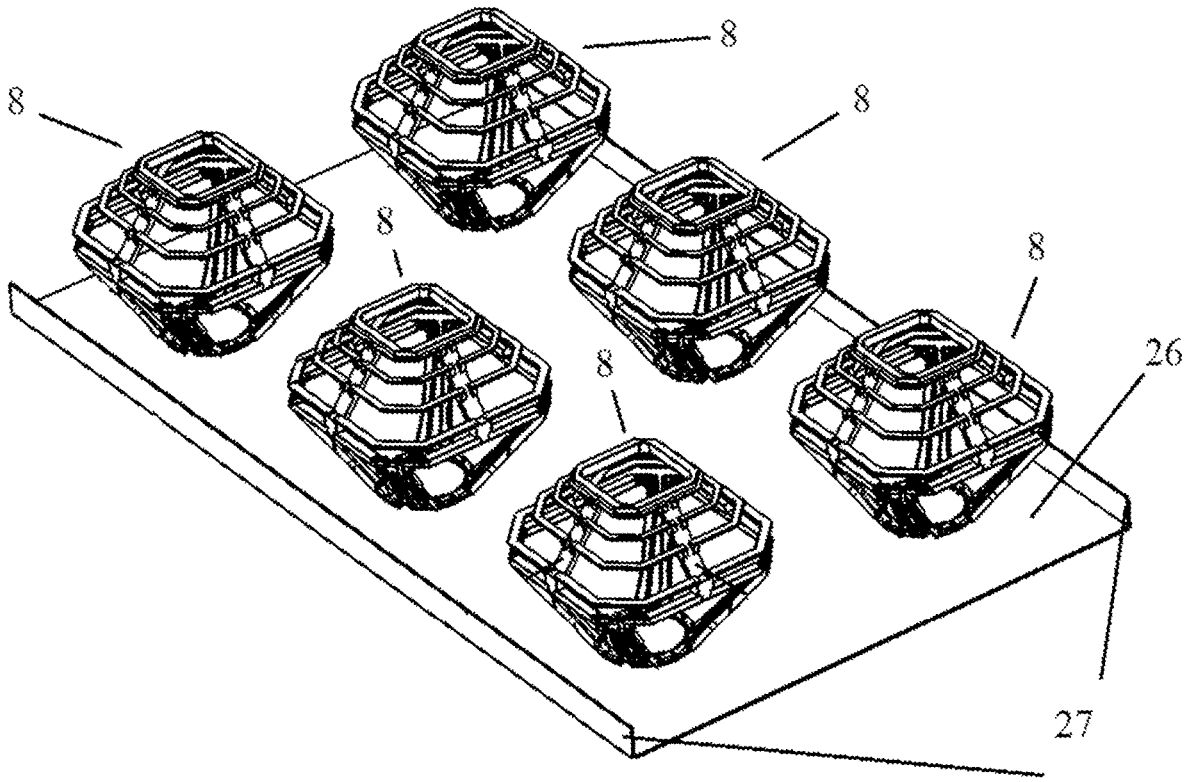
FIG. 7 is a structural schematic diagram of a dual-polarized antenna array in Embodiment 5 of the present application.

In the embodiment, an antenna array is formed by employing the wideband dual-polarized antenna in the embodiment 4. As shown in FIG. 7, in FIG. 7, six dual-polarized antennas in FIG. 6 are employed and are distributed in a two-row and three-column structure on a reflective plate 26, and side walls 27 extending upwards are arranged at side edges of the reflective plate 26. The focusing member with the conical structure can focus the radiation waves from the arms of the dipoles and can effectively reduce radiation interference along the reflective plate 26 on which the adjacent antennas are mounted. The side walls 27 increase the front-to-back ratio of the antenna, but have a drawback that the beamwidth is increased; and the design of the focusing member with the conical structure can effectively reduce the beamwidth so that the size of the reflective plate 26 can be smaller and a radiation direction diagram that meets the requirements is obtained.

Embodiment 6

Figure 8:
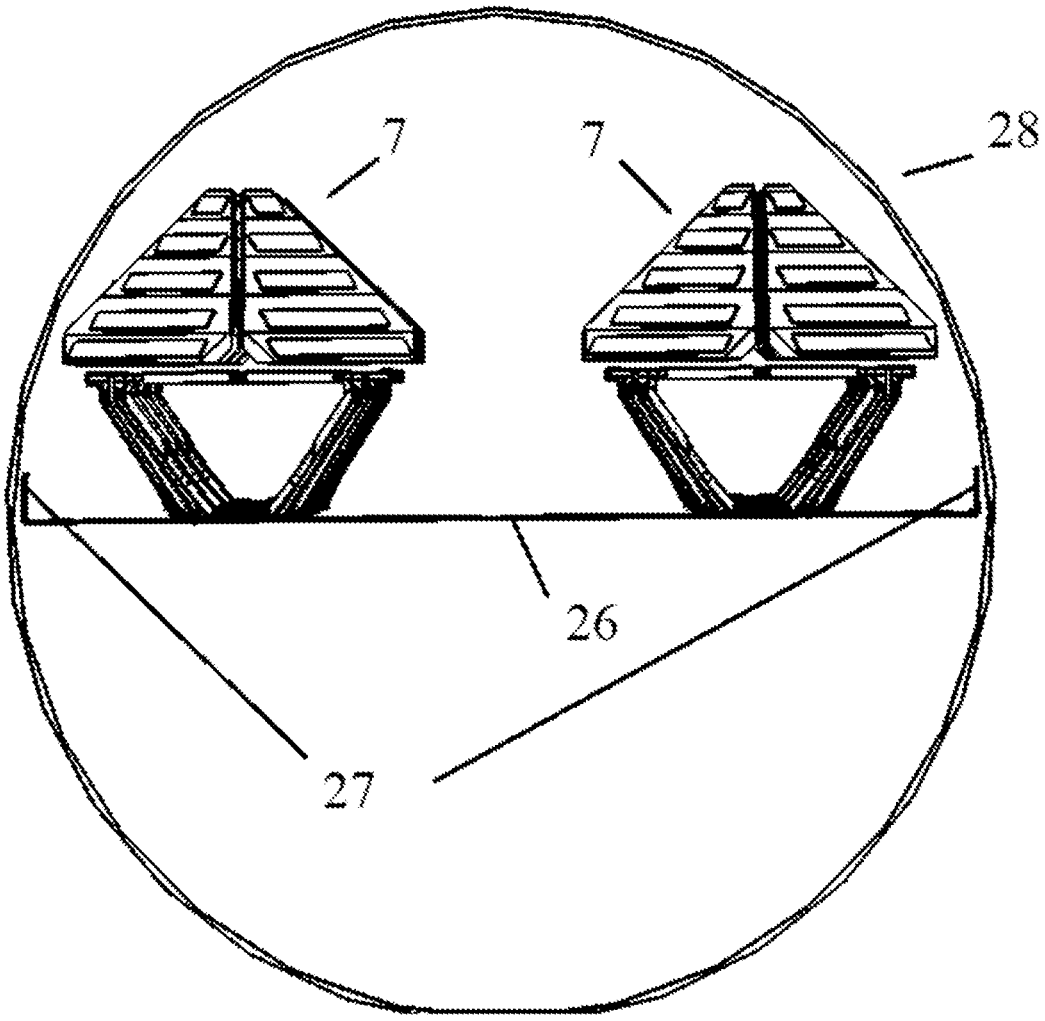
FIG. 8 is a structural schematic diagram of a dual-polarized antenna array having a radome in a circular tube shape in Embodiment 6 of the present application.

In the embodiment, an antenna array is formed by employing the wideband dual-polarized antenna in the embodiment 3, and is placed entirely within a circular tube-shaped radome 28. As shown in FIG. 8, the antenna array as shown in FIG. 8 employs the dual-polarized antenna as shown in FIG. 5; compared with a rectangular radome, the circular tube-shaped radome reduces the wind load and can better protect the antenna; and moreover, due to the focusing member with the conical structure of the dual-polarized antenna array, the size of the reflective plate can be greatly reduced. Therefore, by employing the design, the aperture of the radome 28 can be reduced, the space and consumables are saved.

In addition, in the embodiment, the antenna array as shown in FIG. 7 is mounted in the radome with reference to the mounting manner in FIG. 8 to form a sample to be tested. The sample to be tested is tested in a microwave darkroom, and the test results show that the dual-polarized antenna array has the half-power beamwidth being 60-65 degrees and the cross polarization ratio being less than −10 dB at the edges of +/−60-degree sector, and can can meet most practical application demands.

The above content is for further detailed description of the present application in combination with the specific embodiments, and cannot be construed that the specific embodiments of the present application are only limited to these descriptions. Those of ordinary skill in the art can make a plurality of simple derivations and substitutions without departing from the concept of the present application.

The invention claimed is:

1. A wideband dual-polarized antenna, comprising a reflective plate and a radiating element mounted on the reflective plate, and characterized in that the radiating element comprises four dipoles which are combined together to be arranged on the reflective plate; two arms of each dipole are respectively connected to top ends of two conductors, and bottom ends of the conductors are connected to a common base and are placed on the reflective plate; a focusing member with a conical structure is mounted above the radiating element, and comprises conductive members and dielectric members; and the conductive members are arranged on the dielectric members, are supported by the dielectric members and are arranged above the dipoles.

2. The wideband dual-polarized antenna according to claim 1, characterized in that the focusing member has a conical structure and has a circular, elliptical or polygonal cross section.

3. The wideband dual-polarized antenna according to claim 1, characterized in that the radiating element comprises four balun-fed folded dipoles tilting for 30-90°.

4. The wideband dual-polarized antenna according to claim 1, characterized in that the arms of the dipoles are bent towards a central direction of the radiating element.

5. The wideband dual-polarized antenna according to claim 1, characterized in that a top of the focusing member with the conical structure is excised in part.

6. The wideband dual-polarized antenna according to claim 1, characterized in that in the focusing member, the conductive members have a square, circular, ring-shaped, or other polygonal structure, and the conductive members are placed at an axis part of the radiating element and are parallel to the reflective plate.

7. The wideband dual-polarized antenna according to claim 1, characterized in that the conductive members are supported by the dielectric members and are arranged on the dipoles respectively; and the conductive members are in a shape of a strap, a curved bar, a rectangle, an arc, or a part of a polygon.

8. The wideband dual-polarized antenna according to claim 1, characterized in that at least two radiating members and feeding parts are placed on the reflective plate to form a dual-polarized antenna array.

9. The wideband dual-polarized antenna according to claim 1, characterized in that the reflective plate is at least provided with two side walls.

10. The wideband dual-polarized antenna according to claim 1, characterized by being provided with a circular tube-shaped radome.

* * * * *